United States Patent [19]

Polyblank

[11] Patent Number: 4,634,011

[45] Date of Patent: Jan. 6, 1987

[54] DOUBLE OPENING LID

[76] Inventor: Alan H. Polyblank, 156B Hopetoun Ave., Vaucluse, N.S.W., Australia, 2030

[21] Appl. No.: 739,913

[22] Filed: May 31, 1985

[30] Foreign Application Priority Data

Jun. 5, 1984 [AU] Australia ..... PG5363

[51] Int. Cl.[4] ..... B65D 51/28

[52] U.S. Cl. ..... 215/6

[58] Field of Search ..... 215/6; 220/23; 206/538, 206/539, 540

[56] References Cited

U.S. PATENT DOCUMENTS 1,249,641 12/1917 LeFrancois ..... 215/6 X
2,714,971 8/1955 Workman ..... 220/23 X
2,766,796 10/1956 Tupper ..... 215/6 X
2,944,661 7/1960 Goldstein ..... 215/6 X
2,978,132 4/1961 Huck ..... 215/6 X
4,475,654 10/1984 Fruchter ..... 220/23 X

FOREIGN PATENT DOCUMENTS 91407 12/1982 Australia .

*Primary Examiner*—Donald F. Norton
*Attorney, Agent, or Firm*—Holman & Stern

[57] ABSTRACT

A lid for a tablet bottle having an integral storage compartment for holding predetermined quantity of medication. The quantity of medication for administration during a set period being removed from the bottle and placed in the compartment for ease of monitoring as to dosage rate throughout the period.

3 Claims, 3 Drawing Figures

DOUBLE OPENING LID

The present invention relates to containers but more particularly to container lids suitable for use on pill or tablet bottles and the like.

Various forms of tablet dispensers or containers have been proposed which are adapted to indicate or dispense a metered quantity of medication to be taken during a predetermined period. Such known articles of the type can be of a complex structure and may not be suitable due to cost of production and difficulties in their operation.

The present invention proposes a container lid having a selectively accessible storage compartment separate from the container in which pills or tablets to be taken during, say, a day can be stored so that the user will readily be able to calculate how many tablets of each kind remain to be taken to complete the daily dose. In this way a quick assessment is possible to check that tablets have been taken on time throughout the day.

In one aspect the present invention provides a container lid for fitting to a pill or tablet bottle or container, said lid comprising an uppermost openable closure closing a compartment formed within the lid, said lid being openable when fitted to a container to permit access to the interior of the container and said uppermost closure closing said compartment.

In another form the uppermost openable closure provides access to both the interior of the container and the compartment when opened while fitted to a container.

A first embodiment of a lid of the invention comprises a hinged uppermost flap-like closure and a hinged lowermost closure, the lowermost closure permitting access to the interior of a container when fitted to same, the hinges on the upper and lower closures being diametrically opposed on the lid so that one closure will not be inadvertently opened when it is intended to open the other closure.

The present invention will now be described by way of example with reference to the accompanying drawings, in which.

Figure 1:
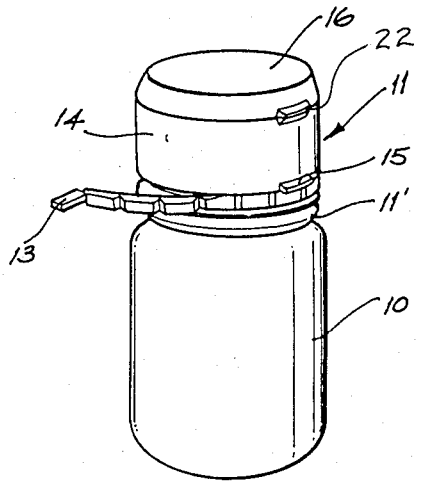
FIG. 1 is a perspective view of a container incorporating a lid in accordance with the present invention.

Referring to the drawings which show a container 10 with a lid 11 mounted thereon and closing the neck 12 thereof.

Figure 2:
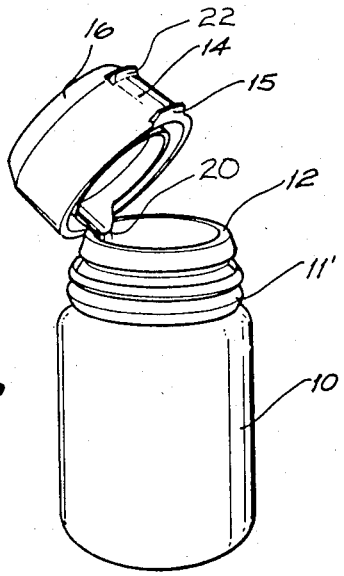
FIG. 2 shows the opening of the lid of FIG. 1 to permit access to the interior of the container.

In FIG. 1 a sealing ring 13 is being shown to be broken and removed from lid 11 so as to free bottom lid 14 to hinge relative to collar 11' on container 10 about a first hinge 20 (see FIG. 2). A tab 15 on bottom lid 14 is lifted to raise the latter and gain access to the contents of container 10.

After bottom lid 14 has been lifted a quantity of the contents, say a number of tablets or capsules, can be removed from the container. The container can then be closed by pressing down lid 11 over the neck 12 of container 10.

Top lid 16 can then be opened about a second hinge 22 (FIG. 3) diametrically opposite hinge 20 by pressing up on tab 17 which is diametrically opposed to tab 15 so as to avoid any tendency for the container 10 to be opened. A first dose of medication may be taken and the remainder of, say, a day's medication can be placed in compartment 18 formed in bottom lid 14 beneath top lid 16 which is then closed until a further dose is required. By this means a ready check can be made as to the progress of administering medication over a predetermined time without the necessity of storing a count of the tablets or capsules as those remaining in compartment 18 define the progress of administration of doses.

Figure 3:
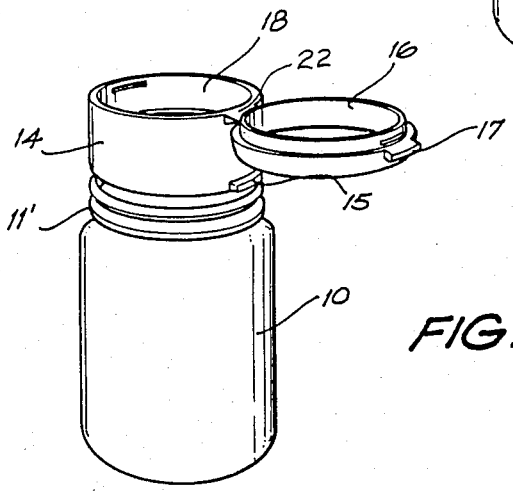
FIG. 3 shows the opening of an upper closure on the lid of FIG. 1 to permit access to the interior of the lid.

In another embodiment the lid comprises an uppermost openable closure which permits access to a compartment such as compartment 18 of the embodiment of FIGS. 1 to 3. Within that compartment there is provided a further openable closure which provides access to the interior of the container. In this embodiment a removable seal is best provided between the uppermost openable closure and the remainder of the lid.

Lids in accordance with the present invention are preferably formed from plastics material.

Another embodiment provides a screw type lid for fitting a complementary opening on a container. Atop the lid is formed a hinged plastics closure moulded integrally with the remainder of the lid and closing a storage compartment within the lid.

Another embodiment provides a compartmentalised plastics lid which is adapted to be a push-fit onto a bottle or like container.

I claim:

1. A container for solid medication products having a neck defining a container opening, a bottom lid, a first hinge connecting the bottom lid to the container neck on one side of the container for selectively opening and closing the container for withdrawing products therefrom, the bottom lid having a peripheral cylindrical wall defining a compartment with an open top for receipt of quantities of the medication products, a top lid, and a second hinge connecting the top lid to the bottom lid on a side of the container opposite said one side for selectively covering and uncovering the open top of the compartment, the relative positioning of the hinges on respectively opposite sides of the container inhibiting opening of the bottom lid when the top lid is raised to uncover the compartment.

2. The container as defined in claim 1 including a removable peripheral sealing ring connected between the bottom lid and the container.

3. The container as defined in claim 1 including a first tab on the bottom lid opposite the first hinge to aid in opening the bottom lid, and a second tab on the top lid opposite the second hinge to aid in opening the top lid.

* * * * *